US012286728B1

(12) United States Patent
Bian

(10) Patent No.: US 12,286,728 B1
(45) Date of Patent: Apr. 29, 2025

(54) MELT-SPUN SINGLE-REACTOR HIGH-VISCOSITY PET/LOW-VISCOSITY PET TWO-COMPONENT ELASTIC FIBER AND PREPARATION METHOD THEREFOR

(71) Applicant: JIANGSU GANGHONG FIBER CO., LTD., Suzhou (CN)

(72) Inventor: Shuchang Bian, Suzhou (CN)

(73) Assignee: JIANGSU GANGHONG FIBER CO., LTD., Suzhou (CN)

( * ) Notice: Subject to any disclaimer, the term of this patent is extended or adjusted under 35 U.S.C. 154(b) by 0 days.

(21) Appl. No.: 18/955,376

(22) Filed: Nov. 21, 2024

Related U.S. Application Data

(63) Continuation-in-part of application No. PCT/CN2024/093278, filed on May 15, 2024.

(30) Foreign Application Priority Data

Dec. 13, 2023 (CN) ..... 202311705741.5

(51) Int. Cl.
*D01D 5/08* (2006.01)
*D01D 1/04* (2006.01)
(Continued)

(52) U.S. Cl.
CPC ..... *D01D 5/08* (2013.01); *D01D 1/04* (2013.01); *D01D 1/106* (2013.01); *D01D 5/30* (2013.01);
(Continued)

(58) Field of Classification Search
CPC ..... D01D 5/08; D01D 1/04; D01D 1/106; D01D 5/30; D10B 2331/04; D10B 2401/061
See application file for complete search history.

(56) References Cited

U.S. PATENT DOCUMENTS 5,814,282 A * 9/1998 Lohe ..... B29B 7/481 366/85

FOREIGN PATENT DOCUMENTS

CN 101126180 A 2/2008
CN 101851812 A 10/2010
(Continued)

OTHER PUBLICATIONS

CN116949600 machine translation (Year: 2023).*

*Primary Examiner* — S. Behrooz Ghorishi
*Assistant Examiner* — Alexander A Wang
(74) *Attorney, Agent, or Firm* — Dinsmore & Shohl LLP

(57) ABSTRACT

A melt-spun single-reactor high-viscosity PET/low-viscosity PET two-component elastic fiber and preparation method therefor. The preparation method includes steps of obtaining an ethylene terephthalate prepolymer, a step of introducing the ethylene terephthalate prepolymer into a final polymerization reactor for polymerization, wherein the final polymerization reactor has a low-viscosity melt outlet from which a low-viscosity PET melt is discharged and a high-viscosity melt outlet from which a high-viscosity PET melt are is discharged, and a step of spinning the low-viscosity PET melt and the high-viscosity PET melt through a same parallel composite spinning assembly to obtain the PET two-component elastic fiber. The method can realize simultaneous polymerization of high-viscosity and low-viscosity components in the same final polymerization reactor, and the obtained fiber has good performance.

17 Claims, 2 Drawing Sheets

(51) Int. Cl.
*D01D 1/10* (2006.01)
*D01D 5/30* (2006.01)

(52) U.S. Cl.
CPC .... *D10B 2331/04* (2013.01); *D10B 2401/061* (2013.01); *D10B 2401/063* (2013.01)

(56) References Cited

FOREIGN PATENT DOCUMENTS

| | | | | |
|---|---|---|---|---|
| CN | 104894688 | A | | 9/2015 |
| CN | 106337212 | A | | 1/2017 |
| CN | 107964690 | A | | 4/2018 |
| CN | 111101237 | A | | 5/2020 |
| CN | 111705370 | A | | 9/2020 |
| CN | 115613159 | A | | 1/2023 |
| CN | 116949600 | | * | 10/2023 |
| CN | 117661152 | A | | 3/2024 |
| KR | 1020040078824 | A | | 9/2004 |
| KR | 1020050007878 | A | | 1/2005 |
| KR | 101720221 | B1 | | 3/2017 |

* cited by examiner

MELT-SPUN SINGLE-REACTOR HIGH-VISCOSITY PET/LOW-VISCOSITY PET TWO-COMPONENT ELASTIC FIBER AND PREPARATION METHOD THEREFOR

CROSS-REFERENCE TO RELATED APPLICATIONS

This application is a Continuation-in-Part of PCT App. Serial No. PCT/CN2024/093278, having an International Filing Date of May 15, 2024, which claims the benefit of priority to Chinese Patent Application No. 202311705741.5 filed on Dec. 13, 2023, and the entire disclosure of both are hereby incorporated by reference.

TECHNICAL FIELD

The present disclosure relates to a melt-spun single-reactor high-viscosity PET/low-viscosity PET two-component elastic fiber and preparation method therefor.

BACKGROUND

The application scope of elastic fibers in the modern chemical fiber industry is becoming wider and wider. Especially in recent years, with the rapid development of the theory of two-component elastic fibers, we have a deeper understanding of the forming mechanism and elasticity generation mechanism of parallel two-component elastic fibers, and the varieties of elastic fibers and original technologies have also made great progress. Starting from the 1970s, DuPont first launched single-component spandex elastic fiber, which quickly became popular in the market with its unique style and characteristics. In the late 1970s, the parallel two-component elastic fiber T800 was launched. Based on PBT/PET parallel compositing, T800 produces good elastic effect. However, due to the low glass transition temperature (26-42° C.) of the PBT component, the fiber undergoes rapid crystallization when subjected to force, and the elastic recovery and shape retention of the fiber T800 are poor. In the 21st century, with the successful industrialization of PDO by chemical and biological fermentation methods, the polyester PTT has a unique molecular structure and excellent elastic recovery performance. DuPont's T400, a PTT/PET two-component elastic fiber, was launched. The PTT/PET two-component parallel composite fiber has excellent elastic recovery and shape retention. The fabric will not deform after repeated stretching. Due to its elastic slow-release effect, T400 overcomes the restraining feeling of spandex elastic fiber. With its excellent resistance to chlorine bleaching and light, T400 has become the best elastic fiber variety in the fabric industry.

However, since the price of the PTT raw material is high, PTT/PET two-component fibers are basically used in the category of high-end fabrics. For some fabrics with lower elasticity requirements, the fibers are not outstanding in cost-effectiveness. Therefore, the development of two-component elastic fibers has become a key area of industry development in the past decade. The latest progress is to, based on the different orientation and crystallization behaviors between PET components of different viscosity, prepare PET/PET two-component elastic fibers by spinning, in parallel, a high-viscosity PET and a low-viscosity PET which have a certain viscosity difference. During the spinning process, due to the different speeds and percentages of transition from an orientation state to a crystallization state, the high-viscosity component and the low-viscosity component produce elastic crimp to form a spring-like structure, thus showing a good elastic effect on the fabric. CN111101237A, CN101126180A, CN106337212A, CN107964690A, CN101851812A, CN115613159A and other patents respectively disclose a series of methods for preparing parallel composite elastic fibers such as PET/PET, PBT/PET, and PTT/PET, as well as methods for preparing easily dyeable or deeply dyeable elastic fibers by using a modified PET with elasticity retention (such as high-viscosity easy cationic dye-modified polyester (ECDP), high-viscosity high-shrinkage polyester, high-viscosity easy disperse dyeable polyester, high-viscosity cationic dye-modified polyester (CDP)) and a low-viscosity PET.

The above-mentioned preparation methods of the elastic fibers are based on the production process of chip spinning of high-viscosity chips and low-viscosity chips respectively through pre-crystallization, melting of drying screw, to composite spinning and composite parallel spinneret forming, although the basic problems of parallel composite spinning technology are solved, chip spinning technology has obvious defects such as long process, high cost, low production capacity, and poor product quality stability.

In the prior art, the synthesis of a high-viscosity melt and a low-viscosity melt is usually carried out in different polymerization reactors. The process of separate polymerization in two reactors will increase the polymerization cost on the one hand, and it is difficult to accurately control the viscosity difference between high-viscosity and low-viscosity melts on the other hand. The existing high-viscosity melt has poor fluidity in the pipeline and is easily degraded during melt transfer, resulting in a decrease in viscosity and further affecting the quality of the final two-component elastic fiber.

SUMMARY OF THE DISCLOSURE

An objective of the present disclosure is to provide a melt-spun single-reactor high-viscosity PET/low-viscosity PET two-component elastic fiber, and the elastic fiber has very high elastic crimp and low production cost. In the preparation of the elastic fiber, the viscosity of the high-viscosity and low-viscosity melts is controllable, the viscosity of the high-viscosity melt is high enough and can be well maintained during the melt conveying process, and the production capacity is high.

Another objective of the present disclosure is to provide a method for preparing a melt-spun single-reactor high-viscosity PET/low-viscosity PET two-component elastic fiber. By simultaneously polymerizing a high-viscosity melt component and a low-viscosity melt component in a same polymerization reactor, and then directly carrying out parallel composite spinning on the two melt compounds, the preparation method can prepare a high-viscosity PET/low-viscosity PET two-component elastic fiber simply and easily, thereby significantly reducing production costs and improving production efficiency.

To achieve the above objectives, the technical solution adopted by the present disclosure is as follows:

A method for preparing a melt-spun PET two-component elastic fiber, the preparation method comprises steps of sequentially passing terephthalic acid, ethylene glycol and a catalyst through a first esterification reactor and a second esterification reactor for esterification reaction, a first prepolymerization reactor and a second prepolymerization reactor for prepolymerization reaction to obtain an ethylene terephthalate prepolymer, the preparation method further comprises a step of introducing the ethylene terephthalate prepolymer into a final polymerization reactor for polymerization, wherein the final polymerization reactor has a low-viscosity melt outlet from which a low-viscosity PET melt is discharged and a high-viscosity melt outlet from which a high-viscosity PET melt is discharged, the low-viscosity PET melt has an intrinsic viscosity of 0.45-0.60, and a dynamic viscosity of 90-300 Pa·s at 280° C., and the high-viscosity PET melt has an intrinsic viscosity of 0.68-0.80, and a dynamic viscosity of 450-810 Pa·s at 284° C.; and a step of spinning the low-viscosity PET melt and the high-viscosity PET melt through a same parallel composite spinning assembly to obtain the melt-spun PET two-component elastic fiber.

In the present disclosure, the intrinsic viscosity is measured in a mixed solvent of phenol and tetrachloroethane with a volume ratio of 3:2.

In the present disclosure, the high-viscosity PET melt and the low-viscosity PET melt are simultaneously synthesized in the same final polymerization reactor and discharged from different positions of the final polymerization reactor respectively, and then spun in the same spinning assembly. In this way, two components (a high-viscosity component and a low-viscosity component) can be simultaneously synthesized in a single reactor, and the entire system may be a five-reactor system.

In the method for preparing the PET two-component elastic fiber of the present disclosure, a five-reactor device system, including a first esterification reactor, a second esterification reactor, a first prepolymerization reactor, a second prepolymerization reactor, and a final polymerization reactor (with the high-viscosity and low-viscosity melts in the same reactor), is adopted.

The PET two-component elastic fiber of the present disclosure comprises two components (a high-viscosity component and a low-viscosity component). The method for preparing the PET two-component elastic fiber is a melt spinning process, that is, the melts obtained by polymerization are directly spun without the steps of melt cooling and chipping and then melting for spinning.

In some embodiments, the PET two-component elastic fiber comprises, in percent by weight, 30%-70% of a high-viscosity PET component and 70%-30% of a low-viscosity PET component, and the viscosity of the high-viscosity PET component is different from the viscosity of the low-viscosity PET component.

In some embodiments, the final polymerization reactor is a horizontal polymerization reactor and comprises a main body containing a chamber internally, the main body includes a low-viscosity zone, a medium-high-viscosity zone, and a high-viscosity zone which are arranged in sequence along an axial direction of the final polymerization reactor, and the viscosity of the polyethylene terephthalate melt in the low-viscosity zone, the medium-high-viscosity zone, and the high-viscosity zone increases in sequence, the low-viscosity melt outlet is arranged at a rear end of the low-viscosity zone, and the high-viscosity melt outlet is arranged at a rear end of the high-viscosity zone; the final polymerization reactor further includes a prepolymer inlet arranged at a front end of the final polymerization reactor, and two agitating shafts, one of which is arranged in the low-viscosity zone and the other is arranged in the medium-high-viscosity zone and the high-viscosity zone, as well as a weir plate arranged at a rear end of the low-viscosity melt outlet and configured to prevent the melt in the medium-high-viscosity zone from flowing into the low-viscosity zone.

In the present disclosure, the final polymerization reactor is divided into front and rear chambers with two shafts for agitating; the front chamber completes low-viscosity polymerization reaction, and the rear chamber completes medium-high-viscosity polyester polymerization reaction; the front end of the reactor is provided with the prepolymer inlet; the low-viscosity melt outlet is designed at the rear end of the agitating shaft of the front chamber to discharge the low-viscosity PET melt for production, and the high-viscosity melt outlet is designed at the rear end of the agitating shaft of the rear chamber to discharge the high-viscosity PET melt for production. The design of the final polymerization reactor can complete the controllable output of low-viscosity and high-viscosity melts which have different intrinsic viscosities in a single reactor and transfer the melts to the two-component parallel composite spinning manifold by spinning lines, thus successfully preparing the high-viscosity PET/low-viscosity PET parallel composite elastic fiber.

In some embodiments, the central axes of the two agitating shafts are located on a same straight line, and the final polymerization reactor further includes a support column arranged on an inner wall of the main body, and the support column is configured to support the two agitating shafts and is located at the rear end of the low-viscosity zone.

In some embodiments, the length of the agitating shaft arranged in the low-viscosity zone is two-thirds of the length of the final polymerization reactor, the length of the agitating shaft arranged in the medium-high-viscosity zone and the high-viscosity zone is one-third of the length of the final polymerization reactor, the length of the low-viscosity zone is two-thirds of the length of the final polymerization reactor, and the length of the medium-high-viscosity zone and the high-viscosity zone is one-third of the length of the final polymerization reactor.

In the present disclosure, two-thirds and one-third are not the exact mathematical values of two-thirds and one-third, but refer to approximately two-thirds, one-third and thereabouts, which are approximately equal to two-thirds and one-third.

In the present disclosure, two agitating shafts are arranged in the low-viscosity zone and the medium-high-viscosity zone and the high-viscosity zone, respectively; the lengths of the two agitating shafts are controlled to be inconsistent, and the agitating shaft in the low-viscosity zone is longer; and a weir plate is arranged on the inner wall of the main body at the rear end of the low-viscosity zone of the final polymerization reactor; the weir plate can separate the medium-high-viscosity melt in the medium-high-viscosity zone from flowing back into the low-viscosity melt in the low-viscosity zone via a gap space between disc reactors and the inner wall of the main body; and further, the simultaneous discharge of the high-viscosity melt and the low-viscosity melt from the same final polymerization reactor is achieved. In this way, the production device and process are simplified, and the viscosity of the high-viscosity melt and the low-viscosity melt can also be better controlled.

In some embodiments, each of the two agitating shafts is provided with a plurality of disc reactors, the disc reactors in the low-viscosity zone are multi-disc combinations, and 6 to 8 multi-disc combinations are arranged in the low-viscosity zone, and the number of the disc reactors in the low-viscosity zone is 35 to 50; the disc reactors in the medium-high-viscosity zone are four-disc combinations, three-disc combinations or two-disc combinations, and the number of the disc reactors in the medium-high-viscosity zone is 15 to 25; the disc reactors in the high-viscosity zone are in a single-disc design, and the number of the disc reactors in the high-viscosity zone is 6 to 15.

In the present disclosure, the multi-disc combination refers to a plurality of adjacent disc reactors that are combined and fixed, and the adjacent disc reactors can synchronously rotate relative to the agitating shaft.

Further, the disc reactors in the low-viscosity zone are multi-disc combinations of more than 4 discs; multi-disc combinations of 8 to 10 discs are designed at the front end of the low-viscosity zone, and multi-disc combinations of 4 to 5 discs are designed at the rear end of the low-viscosity zone.

In some embodiments, the final polymerization reactor further includes a wall scraper arranged in the medium-high-viscosity zone to remove the melt from the inner wall of the final polymerization reactor, a disc scraper arranged in the high-viscosity zone to remove the melt from the disc reactors, a wall scraper arranged in the high-viscosity zone to remove the melt from the inner wall of the final polymerization reactor, and an axial scraper arranged in the high-viscosity zone to remove the melt from the agitating shaft.

In the prior art, although a scraper is arranged in a conventional polymerization reactor, the scraper plays a relatively limited role due to its relatively simple structure. In the high-viscosity zone of the final polymerization reactor of the present disclosure, by adopting the combined scraper with the described specific structure, the renewal rate of materials on the discs of the disc reactors, the surfaces of the agitating shafts and the wall of the polymerization reactor can be effectively controlled, so that the materials in the three positions will not accumulate too much, and the problems of hue degradation and generation of a large amount of acetaldehyde in the production process of the high-viscosity melt can be effectively ameliorated. In the combined scraper of the present disclosure, the disc scraper can control the thickness of a melt film on the discs, the wall scraper can timely renew the material on the wall of the polymerization reactor, and the axial scraper can clean the stirring shaft. By adopting the final polymerization reactor with the described combined scraper, the material residence time can be controlled to be 75 to 120 min, which is much less than the residence time (about 180 to 300 min, typically) of the conventional front and rear double-shaft high-viscosity disc reactor. The significant reduction in residence time effectively reduces the level of side reactions, which is conducive to the preparation of a high-viscosity polyester melt.

In some embodiments, the weir plate is welded to the inner wall at the bottom of the main body, and in a cross section of the final polymerization reactor passing through the weir plate, the curvature of a contact line between the weir plate and the inner wall at the bottom of the main body is greater than or equal to $\pi/6$, and a lowest point of an upper edge of the weir plate is not lower than a secant line of the cross section passing through two end points of the contact line; preferably, the cross section of the weir plate is in an inverted trumpet shape, and in the front-rear direction of the final polymerization reactor, the weir plate is adjacent to the low-viscosity melt outlet.

In some embodiments, the spacing between the multi-disc combinations and between each disc in one multi-disc combination in the low-viscosity zone, the spacing between the two-disc combinations and between each disc in one two-disc combinations in the medium-high-viscosity zone, the spacing between the discs of the single discs in the high-viscosity zone increase in sequence; the diameters of multiple disc reactors in the high-viscosity zone decrease in sequence from front to rear, and the diameter of the disc reactor at a most rear end of the high-viscosity zone is 85%-90% of the diameter of the disc reactor at a most front end of the high-viscosity zone.

In the present disclosure, in the overall disc design, according to the characteristics of gradually increasing viscosity along the axis, the widths of the liquid carrier disc surfaces of the discs are gradually narrowed, which can effectively reduce the shaft load. Moreover, for the single-disc combination area in the high-viscosity zone, the outer diameters of the discs at the rear end are gradually reduced to expand the flow space area of volatiles at the rear end. The variation range given herein is that from the first single disc at the rear end to the last single disc, the outer diameters of the discs are gradually reduced to 85%-90% of the first single disc. In the meanwhile, the thickness of the discs is gradually increased to meet the gradually increasing viscosity stress requirements. In the disc reactor design, according to the characteristics of gradually increasing viscosity along the axie, the radius of the disc reactors gradually narrows. As a result, the load on the agitating shafts is reduced on the one hand, and the outer diameters of disc reactor at the rear end are gradually reduced on the other hand, which can increase the spatial area for the flow of volatile components at the rear end, thereby expanding the flow space area of volatiles at the rear end.

In some embodiments, the disc reactors in the high-viscosity zone are at an angle of 1.0-3.0° with the vertical direction of the agitating shaft, and the upper ends of the disc reactors face the rear end of the high-viscosity zone.

In the present disclosure, for the single disc area located in the high-viscosity zone, in order to ensure the advancing effect of the high-viscosity material, the single discs are designed to be arranged at an angle of 1.0-3.0° with the vertical direction of the agitating shaft in the rear chamber to form a certain driving force. In this way, the devolatilization effect is achieved, and the high-viscosity material is also pushed forward to ensure that the material will not stagnate.

In some embodiments, the final polymerization reactor further includes steam feed ports for introducing superheated ethylene glycol steam arranged at the top of the main body corresponding to the rear end of the low-viscosity zone, the rear end of the medium-high-viscosity zone, and the rear end of the high-viscosity zone. The preparation method further includes steps of metering the superheated ethylene glycol steam with a metering system and introducing the steam into the final polymerization reactor. The steam feed ports are arranged in the final polymerization reactor to achieve regular alcoholysis of gel and carbonized materials produced in the high-viscosity zone during the long-period operation of the device, thereby preventing carbonization on the top of the reactor. Moreover, according to the pressure increase of the spinning assembly, the viscosity of the materials on the discs in the high-viscosity zone are timely reduced and the materials are timely removed, so that the long-period aged and deteriorated materials are depolymerized and removed from the surfaces of the discs, thereby rebuilding the material distribution of the discs and prolonging the operation period of the device.

In some embodiments, the final polymerization reactor is connected to a vacuum pump, wherein the vacuum pump is a liquid ring pump and a chilled water device for cooling gas is arranged at an inlet of the liquid ring pump. In the preparation method, the vacuum pump is controlled to have a sucking rate of 200-350 kg/h, the vacuum pump has an ultimate vacuum of 50-65 Pa, and in a production state, the vacuum degree in the final polymerization reactor is controlled to be 100-180 Pa.

In the present disclosure, due to the increase of side reactions of materials in the high-viscosity zone and the overall decrease in the efficiency of devolatilization, the amount of volatiles produced in the final polymerization reactor is 2.5-3.2 times that of a conventional polyester unit with the same production capacity. The higher the viscosity at the high-viscosity melt outlet, the higher the amount of non-condensable gas produced. Therefore, the sucking rate of the vacuum pump is designed to be 2.0-3.0 times that of a conventional polyester unit with the same production capacity, the ultimate vacuum is designed to be 50-65 Pa, and the sucking rate is designed to be 200-350 kg/h, and a large-capacity chilled water device is designed at the inlet of the vacuum pump (the liquid ring pump) to capture excess non-condensable acetaldehyde. In order to further maintain production stability, all ethylene glycol produced from the vacuum part of the device must be subjected to formaldehyde removal treatment before entering the system.

In some embodiments, melt pumps are used to transfer the high-viscosity PET melt and the low-viscosity PET melt, a melt cooler is arranged at an outlet of each melt pump, and in the preparation method, the temperature of the high-viscosity PET melt cooled by the melt cooler is controlled to be 284-286° C.; a filter and a booster pump are arranged between each melt pump and the parallel composite spinning assembly; in the preparation method, the transfer time of the high-viscosity PET melt is controlled to be 25-35 min; and a plurality of static slow-flow mixers are arranged at a front end of a melt pipeline.

In the present disclosure, an ultra-short-process efficient high-viscosity polyester melt transfer design is provided; a large-capacity melt cooler is equipped at the outlet of each melt pump to ensure that the melt temperature is quickly controlled to be 284-286° C., and then the melts are transferred to spinning units via filters and booster pumps. The design concept of the ultra-short process is to transfer the final polymerization reactor from the polymerization device to the top of the spinning device, and the melts are transferred to the spinning units within the shortest transfer time. The conventional polyester melt transfer time is generally 50-70 min, and the short process for high-viscosity melt transfer requires the transfer time to be reduced to 25-35 min. A more stringent design is that the residual internal stress kinetic energy of the melt must be completely released within this residence time range. Therefore, a special front-end multi-position static slow-flow mixer is designed to quickly achieve the plug flow effect without increasing the residence time.

In some embodiments, the preparation method further includes a step of introducing a heat stabilizer, an antioxidant or a colorant into the second esterification reactor before the esterification reaction in the second esterification reactor, wherein the heat stabilizer is selected from the group consisting of trimethyl phosphate, triethyl phosphate, triphenyl phosphate, triphenyl phosphite, triglycerol phosphate, and combinations thereof; the antioxidant is selected from the group consisting of Antioxidant 168, Antioxidant 1076, Antioxidant 1010, Antioxidant 1222, benzothiazole antioxidants, and combinations thereof.

The introduction of the heat stabilizer and the antioxidant into the second esterification reactor can improve the thermal stability and oxidation resistance of the high-viscosity PET melt, so that side reactions can be suppressed during the esterification and polymerization process, and the viscosity drop caused by thermal degradation of the high-viscosity melt during the residence time of up to 40 to 90 min in the melt spinning process can be suppressed, and the intrinsic viscosity level of the melt is ensured to be still high in the spinning manifold, thereby generating sufficient elastic crimp.

In some embodiments, a filter is arranged between the low-viscosity melt outlet of the final polymerization reactor and the parallel composite spinning assembly and between the high-viscosity melt outlet of the final polymerization reactor and the parallel composite spinning assembly, respectively; the preparation method further includes a step of introducing a viscosity reducer into the high-viscosity PET melt by a pipe injector before the high-viscosity PET melt passes through the filter; the viscosity reducer is selected from the group consisting of poly(ethylene terephthalateco-1,4-cyclohexanedimethylene terephthalate) PETG, cationic dyeable polyester CDP, easy cationic dyeable polyester ECDP, atmospheric pressure boiling dyeing polyester EDDP, polybutylene terephthalate PBT, poly(trimethylene terephthalate) PTT, amorphous polyester and combinations thereof; the amount of the viscosity reducer is 0.2% to 3.0% of the total mass of the melt.

Before the high-viscosity melt is transferred to the filter, an additive injection system is designed to inject the viscosity reducer. The addition of the viscosity reducer can greatly improve the fluidity of the high-viscosity melt, improve the internal stress elimination effect of the high-viscosity melt, and enhance the plug flow effect. It can achieve a more stable spinning effect and improved fiber crimp, without affecting the basic indicators and quality of the final two-component elastic fiber product.

Preferably, the amount of the viscosity reducer is 0.5-2.0%, more preferably 0.8-1.5%, of the total mass of the melt. The addition of the viscosity reducer can greatly reduce the kinematic viscosity of the high-viscosity melt, improve the melt transfer efficiency, and reduce process degradation.

In some embodiments, the preparation method further includes a step of introducing a solid-phase smoothing agent into the ethylene terephthalate prepolymer before introducing the ethylene terephthalate prepolymer into the final polymerization reactor, and a step of passing a mixture of the solid-phase smoothing agent and the ethylene terephthalate prepolymer through a filter, wherein the solid-phase smoothing agent is in the form of a masterbatch and comprises a polyester matrix and an inorganic powder, the inorganic powder is selected from the group consisting of talc powder, montmorillonite, barium sulfate, hydrotalcite, nano silica, and combinations thereof, and the amount of the solid-phase smoothing agent is 0.05%-1.0% of the total mass of the melt.

The solid-phase smoothing agent is an inert powder that can produce a good slip effect. The solid-phase smoothing agent can reduce the rapid thickening effect of the high-viscosity melt, and also can form vaporization centers, accelerate the overflow of small molecular materials, improve the devolatilization efficiency and melt transfer, reduce the temperature rise effect, greatly reduce the kinematic viscosity of the high-viscosity melt and improve the melt transfer efficiency. The addition of the solid-phase smoothing agent can generate friction between the fluid surface and the pipe wall, thereby improving the fluidity of the melt and reducing the viscosity of the melt accordingly.

Preferably, the amount of the solid-phase smoothing agent is 0.06%-0.8%, more preferably 0.1%-0.5%, of the total mass of the melt.

In some embodiments, a filter is arranged between the low-viscosity melt outlet of the final polymerization reactor and the parallel composite spinning assembly and between the high-viscosity melt outlet of the final polymerization reactor and the parallel composite spinning assembly, respectively; the preparation method further includes a step of introducing a liquid-phase lubricant into the high-viscosity PET melt before the high-viscosity PET melt passes through the filter; the liquid-phase lubricant is one or more of polyethylene glycol with a molecular weight of 8000-20000, polyetheramine with a molecular weight of 10000-20000, poly(butylene glycol)adipate with a molecular weight of 5000-20000, poly(ethylene glycol)adipate with a molecular weight of 5000-20000, and polyacrylate, and the amount of the liquid-phase lubricant is 0.1%-2.0% of the total mass of the melt.

Preferably, the amount of the liquid-phase lubricant is 0.3%-1.5%, more preferably 0.5%-1.0%, of the total mass of the melt.

In some embodiments, a difference between the intrinsic viscosity of the high-viscosity PET melt and the intrinsic viscosity of the low-viscosity PET melt is 0.18-0.35, and a difference between the dynamic viscosity of the high-viscosity PET melt and the dynamic viscosity of the low-viscosity PET melt is 250-700 Pa·s.

In some embodiments, the final polymerization reactor is arranged at the top of the spinning assembly. In this way, the transfer distance of the high-viscosity and low-viscosity polyester melts synthesized in the final polymerization reactor, especially the high-viscosity melt, before spinning, can be reduced.

In some embodiments, the same spinning assembly is a composite spinning manifold.

In some embodiments, the composite spinning manifold includes a composite spinneret.

The present disclosure further provides a PET two-component elastic fiber prepared by the preparation method described above.

In some embodiments, the PET two-component elastic fiber has a crimp contraction of 12.0%-36.0%.

Due to the application of the described technical solutions, the present disclosure has the following advantages compared with the prior art:

In the present disclosure, the high-viscosity melt and the low-viscosity melt are simultaneously synthesized in the same final polymerization reactor and discharged from different positions of the final polymerization reactor respectively, and then spun in the same spinning assembly. In this way, two components (a high-viscosity component and a low-viscosity component) can be simultaneously synthesized in a single reactor, and the entire system may be a five-reactor system.

The PET two-component elastic fiber of the present disclosure includes two components (a high-viscosity component and a low-viscosity component). The method for preparing the PET two-component elastic fiber is a melt spinning process, that is, the melts obtained by polymerization are directly spun without the steps of melt cooling and chipping and then melting for spinning.

In the present disclosure, two agitating shafts are arranged in the low-viscosity zone and the medium-high-viscosity zone and the high-viscosity zone, respectively; the lengths of the two agitating shafts are controlled to be inconsistent, and the stirring shaft in the low-viscosity zone is longer; and a weir plate is arranged on the inner wall of the main body at the rear end of the low-viscosity zone of the final polymerization reactor; the weir plate can prevent the medium-high-viscosity melt in the medium-high-viscosity zone from flowing back into the low-viscosity melt in the low-viscosity zone via a gap space between disc reactors and the inner wall of the main body; moreover, a low-viscosity melt outlet is designed at the rear end of the low-viscosity zone, and a high-viscosity melt outlet is arranged in the high-viscosity zone, thereby achieving the simultaneous discharge of the high-viscosity melt and the low-viscosity melt from the same final polymerization reactor. In this way, the production device and process are simplified, and the viscosity of the high-viscosity melt and the low-viscosity melt can also be better controlled.

In the present disclosure, the intrinsic viscosity of the high-viscosity melt from high-viscosity melt outlet of the final polymerization reactor reaches 0.68-0.80, and the viscosity of the high-viscosity melt at 280-282° C. is 550-800 Pa·s, which is much higher than the viscosity of the high-viscosity melt in the prior art. The intrinsic viscosity difference between the high-viscosity melt and the low-viscosity melt in the final polymerization reactor reaches 0.23-0.45, which is much higher than that in the prior art.

In the PET two-component elastic fiber of the present disclosure, the intrinsic viscosity of the high-viscosity PET component (first PET component) reaches 0.645-0.750. The crimp contraction of the PET two-component elastic fiber reaches 36.0%, which is much higher than that of the existing two-component elastic fiber.

When used for industrial production of a two-component elastic fiber, the preparation method of the present disclosure can achieve a low-viscosity melt capacity of 100,000 tons/year and a high-viscosity melt capacity of 100,000 tons/year. When the product is melt-spun high-viscosity PET/low-viscosity PET two-component elastic fiber, the overall device capacity is 200,000 tons/year.

wherein, 1. low-viscosity zone; 2. medium-high-viscosity zone; 3. high-viscosity zone; 4. combined scraper; 5. disc scraper; 6. axial scraper; 7. wall scraper; 8. agitating shaft; 9. disc reactor; 10. first esterification reactor; 11. second esterification reactor; 12. first prepolymerization reactor; 13. second prepolymerization reactor; 14. final polymerization reactor; 15. melt pump; 16. high-viscosity melt outlet; 17. low-viscosity melt outlet; 18. weir plate; 19. steam feed port; 20. prepolymer inlet; 21. support column.

DETAILED DESCRIPTION OF THE EXEMPLARY EMBODIMENTS

The above solutions are further described in conjunction with specific embodiments below. It should be understood that these embodiments are used to illustrate the basic principles, main features and advantages of the disclosure, and the disclosure is not limited by the scope of the following embodiments. The implementation conditions used in the embodiments can be further adjusted according to specific requirements, and the implementation conditions not specified are usually the conditions in conventional experiments. In the following embodiments, unless otherwise specified, all raw materials are purchased from commercial sources or prepared by conventional methods in the art.

The above embodiments are only for illustrating the technical concept and features of the disclosure, and their purpose is to enable people familiar with this technology to understand the content of the disclosure and implement it accordingly, but not to limit the scope of the disclosure. Any equivalent changes or modifications made according to the spirit of the disclosure should fall within the scope of the disclosure.

The disclosure is further described below in conjunction with the accompanying drawings and the preferred embodiments of the disclosure. In the following embodiments, it should be noted that directions referred to as terms "front" and "rear" are based on the flow direction of the material, the direction in which the material flows first is the front, and the direction in which the material flows later is the rear. For example, in FIG. 2, the term "front" refers to the right side in FIG. 2, and the term "rear" refers to the left side in FIG. 2. Therefore, the orientation and positional relationship described in the present disclosure are only for the convenience of describing the disclosure and simplifying the description, rather than indicating or implying that the device or element referred to must have a specific orientation, only have a specific orientation, be constructed and operated in a specific orientation, and therefore cannot be understood as a limitation on the disclosure.

Figure 1:
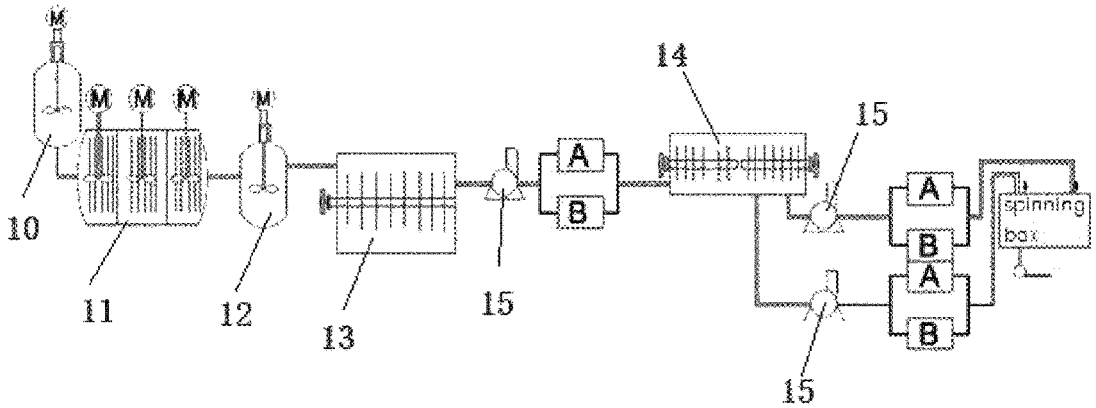
FIG. 1 is a schematic diagram of a five-reactor polymerization system used in an embodiment of the present disclosure.

As shown in FIG. 1, during the preparation of the PET two-component elastic fiber in an embodiment, a five-reactor device system, including a first esterification reactor 10, a second esterification reactor 11, a first prepolymerization reactor 12, a second prepolymerization reactor 13, and a final polymerization reactor 14 (with the high-viscosity and low-viscosity melts in the same reactor), is adopted. The five reactors are connected by necessary pipelines. A pump 15 and filters A and B are arranged between the second prepolymerization reactor 13 and the final polymerization reactor 15. In an actual production process, the filters A and B are not turned on at the same time. For example, the filter A may be turned on first, and after running for a period of time, the device is switched to the filter B, and then the filter A may be cleaned.

Figure 2:
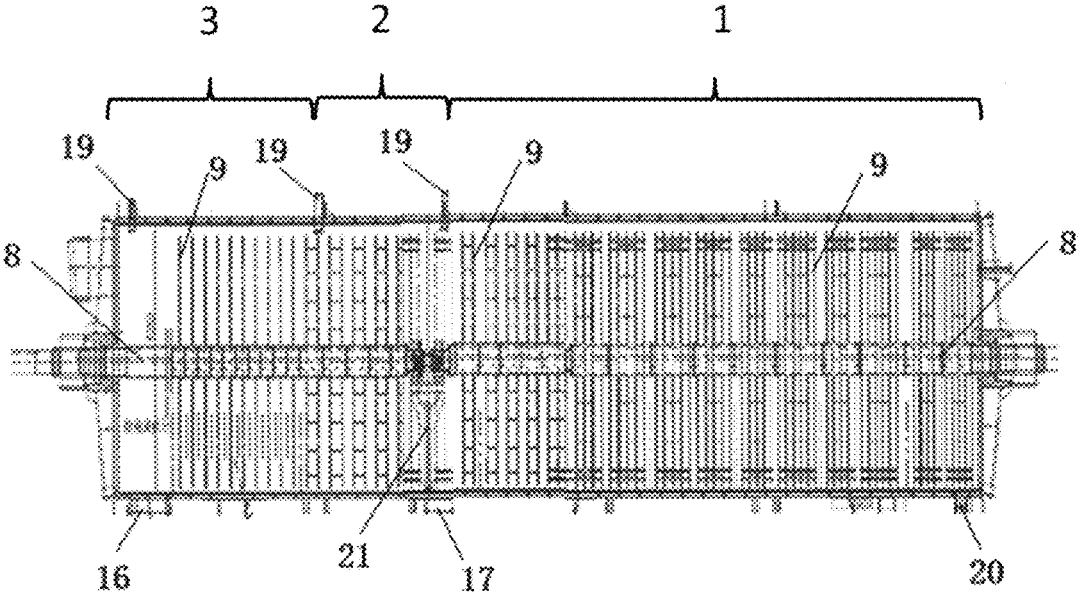
FIG. 2 is a schematic structural diagram of a final polymerization reactor used in an embodiment of the present disclosure.
Figure 3:
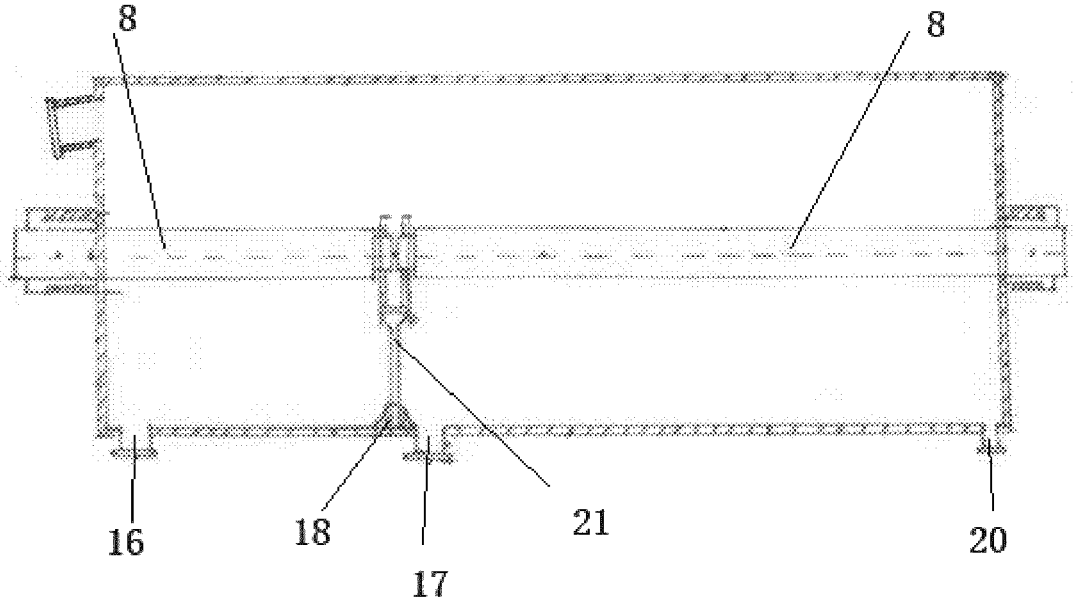
FIG. 3 is another schematic structural diagram of the final polymerization reactor used in an embodiment of the present disclosure.

As shown in FIGS. 2 and 3, the final polymerization reactor 14 is a horizontal polymerization reactor, and comprises a main body containing a chamber internally. The main body includes a low-viscosity zone 1, a medium-high-viscosity zone 2, and a high-viscosity zone 3 which are arranged in sequence along the axial direction of the final polymerization reactor. The viscosity of the polyethylene terephthalate melt in the low-viscosity zone 1, the medium-high-viscosity zone 2, and the high-viscosity zone 3 increases in sequence. A low-viscosity melt outlet 17 is arranged at the rear end of the low-viscosity zone 1, and a high-viscosity melt outlet 16 is arranged at the rear end of the high-viscosity zone 3. The final polymerization reactor 14 further includes a prepolymer inlet 20 arranged at the front end of the final polymerization reactor 14, and two agitating shafts 8, one of which is arranged in the low-viscosity zone 1 and the other is arranged in the medium-high-viscosity zone 2 and the high-viscosity zone 3, as well as a weir plate 18 arranged at the rear end of the low-viscosity melt outlet 17 and configured to prevent the melt in the medium-high-viscosity zone 2 from flowing into the low-viscosity zone 1.

The central axes of the two agitating shafts 8 are located on a same straight line. The final polymerization reactor 14 further includes a support column 21 arranged on an inner wall of the main body. The support column 21 is configured to support the two agitating shafts 8 and is located at the rear end of the low-viscosity zone 1.

The length of the agitating shaft 8 arranged in the low-viscosity zone 1 is two-thirds of the length of the final polymerization reactor 14, the length of the agitating shaft 8 arranged in the medium-high-viscosity zone 2 and the high-viscosity zone 3 is one-third of the length of the final polymerization reactor 14, the length of the low-viscosity zone 1 is two-thirds of the length of the final polymerization reactor 14, and the length of the medium-high-viscosity zone 2 and the high-viscosity zone 3 is one-third of the length of the final polymerization reactor 14. One-third and two-thirds, as used above, are not the exact mathematical values, but are approximately equal to one-third and two-thirds.

Each of the two agitating shafts 8 is provided with a plurality of disc reactors 9, the disc reactors 9 in the low-viscosity zone 1 are multi-disc combinations, and 6 to 8 multi-disc combinations are arranged in the low-viscosity zone 1, multi-disc combinations of 8 to 10 discs are designed at the front end of the low-viscosity zone 1, multi-disc combinations of 4 to 5 discs are designed at the rear end, and the number of the disc reactors in the low-viscosity zone is 35 to 50; the disc reactors 9 in the medium-high-viscosity zone 2 are four-disc combinations, three-disc combinations or two-disc combinations, and the number of the disc reactors in the medium-high-viscosity zone is 15 to 25; the disc reactors 9 in the high-viscosity zone 3 are in a single-disc design, and the number of the disc reactors in the high-viscosity zone is 6 to 15.

The weir plate 18 is welded to the inner wall at the bottom of the main body, and in a cross section of the final polymerization reactor passing through the weir plate, the curvature of a contact line between the weir plate 18 and the inner wall at the bottom of the main body is greater than or equal to $\pi/6$, and a lowest point of an upper edge of the weir plate is not lower than a secant line of the cross section passing through two end points of the contact line; preferably, the cross section of the weir plate 18 is in an inverted trumpet shape, and in the front-rear direction of the final polymerization reactor 18, the weir plate 18 is adjacent to the low-viscosity melt outlet 19.

Figure 4:
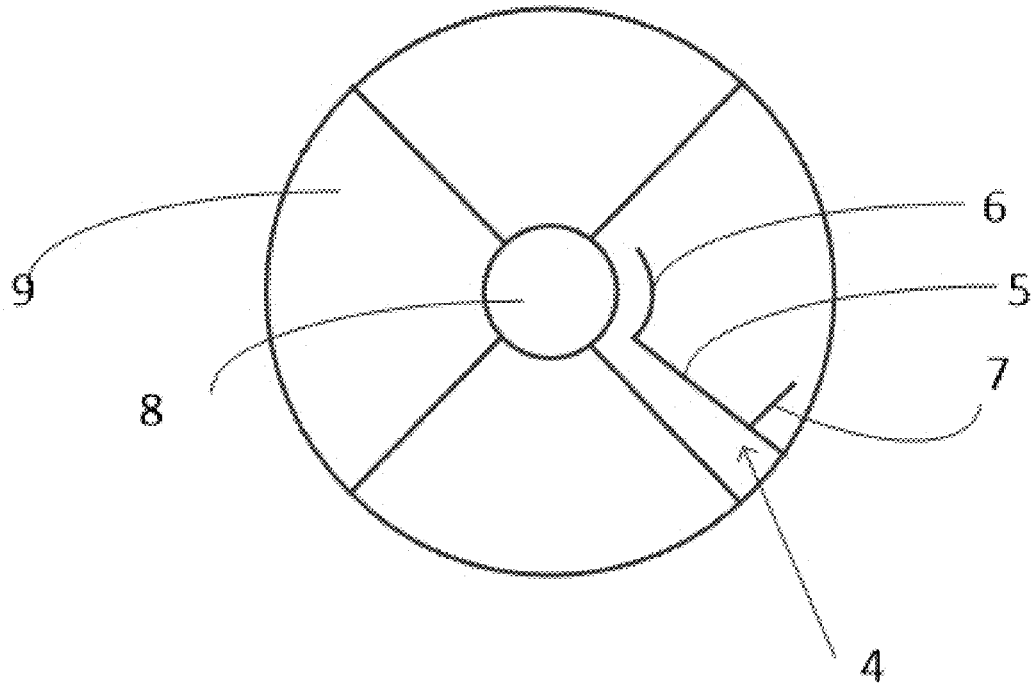
FIG. 4 is a schematic structural diagram of a combined scraper of the final polymerization reactor used in an embodiment of the present disclosure.

As shown in FIGS. 2 and 4, the final polymerization reactor 14 further includes a wall scraper 7 arranged in the medium-high-viscosity zone 2 to remove the melt from the inner wall of the final polymerization reactor 14, a disc scraper 5 arranged in the high-viscosity zone 3 to remove the melt from the disc reactors 9, a wall scraper 7 arranged in the high-viscosity zone 3 to remove the melt from the inner wall of the final polymerization reactor 14, and an axial scraper 6 arranged in the high-viscosity zone 3 to remove the melt from the stirring shaft 8.

the spacing between the multi-disc combinations and between each disc in one multi-disc combination in the low-viscosity zone 1, the spacing between the two-disc combinations and between each disc in one two-disc combinations in the medium-high-viscosity zone 2, the spacing between the discs of the single discs in the high-viscosity zone 3 increase in sequence; the diameters of multiple disc reactors 9 in the high-viscosity zone 3 decrease in sequence from front to rear, and the diameter of the disc reactor 9 at the most rear end of the high-viscosity zone 3 is 85%-90% of the diameter of the disc reactor 9 at the most front end of the high-viscosity zone 3. The disc reactors 9 in the high-viscosity zone 3 are at an angle of 1.0-3.0° with the vertical direction of the agitating shaft, and the upper ends of the disc reactors 9 face the rear end of the high-viscosity zone 3.

The final polymerization reactor 14 further includes steam feed port 17 for introducing superheated ethylene glycol steam arranged at the top of the main body corresponding to the rear end of the low-viscosity zone 1, the rear end of the medium-high-viscosity zone 2, and the rear end of the high-viscosity zone 3.

The final polymerization reactor 14 is connected to a vacuum pump, wherein the vacuum pump is a liquid ring pump and a chilled water device for cooling gas is arranged at an inlet of the liquid ring pump. Melt pumps are used to transfer the high-viscosity PET melt and the low-viscosity PET melt, and a melt cooler is equipped at the outlet of each melt pump.

The second esterification reactor 11 further includes inlets for introducing a heat stabilizer, an antioxidant, and a colorant. The second esterification reactor 11 adopts a three-chamber design, and each chamber is designed with inlets for the foregoing three auxiliaries.

After the second prepolymerization reactor 13 and before the final polymerization reactor 14, a dynamic mixer and a filter are arranged; and before the dynamic mixer, a solid-phase smoothing agent injection system is arranged.

After the final polymerization reactor 14 and before the same spinning assembly, a dynamic mixer and a filter are arranged; and before the dynamic mixer, a viscosity reducer injection system is arranged.

The same spinning assembly is a composite spinning manifold, and the final polymerization reactor 14 is arranged at the top of the composite spinning manifold, thereby shortening the transfer distance of the melt, especially the high-viscosity melt.

Example 1

This example provides a method for preparing a PET two-component elastic fiber, and the specific steps are as follows:

In the described five-reactor polymerization device, terephthalic acid, ethylene glycol, and a catalyst ethylene glycol antimony were passed sequentially through the first esterification reactor 10 and the second esterification reactor 11 for esterification reaction and then the first prepolymerization reactor 12 and the second prepolymerization reactor 13 for prepolymerization reaction to obtain an ethylene terephthalate prepolymer, where the flow rate of terephthalic acid was 2500 kg/h-25000 kg/h, the flow rate of ethylene glycol was 1000 kg/h-10000 kg/h, and the mass content of antimony element of the catalyst in the melt was 180-210 ppm. Then, the ethylene terephthalate prepolymer was introduced into the final polymerization reactor 14 for polymerization, and a high-viscosity PET melt was discharged from the high-viscosity melt outlet 16 of the final polymerization reactor 14, and a low-viscosity PET melt was discharged from the low-viscosity melt outlet 17. Finally, the two melts were transferred, at a mass ratio of 5:5, to the same parallel composite spinning manifold by the melt pipeline to be spun, and a PET two-component elastic fiber was obtained. The PET two-component elastic fiber was FDY with a specification of 83 dtex/36f.

The condition setting of the five-reactor polymerization device and the properties of the high-viscosity PET melt and the low-viscosity PET melt in the final polymerization reactor 14 are shown in Table 1 below. Each melt was first dissolved in a mixed solvent of phenol and tetrachloroethane (v/v: 3:2) and then tested for its intrinsic viscosity in dL/g.

TABLE 1

| No. | Intrinsic viscosity of prepolymer | Vacuum degree of final polymerization reactor/Pa | Low-viscosity melt outlet temperature/° C. | Stirring speed of agitating shaft in low-viscosity zone/rpm | Intrinsic viscosity of low-viscosity melt | High-viscosity melt outlet temperature/° C. | Stirring speed of agitating shaft in medium-high-viscosity zone and high-viscosity zone/rpm | Intrinsic viscosity of high-viscosity melt | Intrinsic viscosity difference between high-viscosity and low-viscosity melts |
|---|---|---|---|---|---|---|---|---|---|
| 1 | 0.260 | 108.0 | 282.4 | 5.6 | 0.471 | 286.9 | 2.65 | 0.752 | 0.281 |
| 2 | 0.265 | 114.6 | 282.2 | 5.5 | 0.473 | 286.9 | 2.65 | 0.750 | 0.277 |
| 3 | 0.269 | 119.3 | 282.2 | 5.5 | 0.469 | 286.3 | 2.58 | 0.755 | 0.286 |
| 4 | 0.275 | 125.6 | 282.0 | 5.3 | 0.502 | 286.5 | 2.55 | 0.781 | 0.279 |
| 5 | 0.279 | 132.8 | 281.7 | 5.3 | 0.505 | 285.8 | 2.50 | 0.785 | 0.280 |
| 6 | 0.286 | 141.5 | 281.5 | 5.2 | 0.503 | 285.3 | 2.50 | 0.782 | 0.279 |
| 7 | 0.293 | 152.7 | 281.2 | 5.0 | 0.547 | 284.6 | 2.35 | 0.848 | 0.301 |
| 8 | 0.306 | 166.2 | 281.2 | 4.8 | 0.552 | 284.4 | 2.26 | 0.851 | 0.299 |
| 9 | 0.310 | 172.8 | 281.0 | 4.7 | 0.550 | 284.2 | 2.22 | 0.853 | 0.303 |

Example 2

This example provides a method for preparing a PET two-component elastic fiber and this method is basically the same as that of Example 1, except that: a common titanium dioxide matting agent was also fed to the second esterification reactor 11, and the amount of the common titanium dioxide matting agent was 0.3% relative to the total mass of the melt; a heat stabilizer, an antioxidant, and a colorant were introduced to the second esterification reactor 11, and specifically the heat stabilizer, the antioxidant, and the colorant were trimethyl phosphate, 1222, and blue colorant respectively in the respective amounts of 20 ppm, 50 ppm, and 1 ppm relative to the molar amount of terephthalic acid; the intrinsic viscosity of the low-viscosity PET melt was controlled to be 0.47, and the intrinsic viscosity of the high-viscosity PET melt was controlled to be 0.72; after melt transfer, the online intrinsic viscosity of the low-viscosity PET melt was 0.463, the online intrinsic viscosity of the high-viscosity PET melt was 0.673, and the difference therebetween was 0.200. Continuous spinning was performed to produce FDY with the specification of 83 dtex/36f, and the fiber properties at different spinning positions on the same spinning producing line are shown in Table 2 below. The fiber properties of the present disclosure were all tested in accordance with the GBT8960-2015 test standard:

TABLE 2

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 82.7 | 2.81 | 31.76 | 1.60 | 1.078 | 17.72 | 29.4 | 4 |
| 2 | 83/36 | 82.9 | 2.86 | 32.17 | 1.67 | 1.084 | 18.01 | 29.8 | 4 |
| 3 | 83/36 | 83.0 | 2.82 | 32.58 | 1.58 | 1.064 | 18.41 | 30.1 | 6 |
| 4 | 83/36 | 82.8 | 2.83 | 31.10 | 1.50 | 1.088 | 18.11 | 30.0 | 4 |
| 5 | 83/36 | 82.9 | 2.86 | 32.64 | 1.59 | 1.090 | 17.74 | 30.8 | 4 |
| 6 | 83/36 | 82.8 | 2.75 | 31.98 | 1.53 | 1.125 | 18.33 | 30.4 | 6 |
| 7 | 83/36 | 82.6 | 2.77 | 31.81 | 1.61 | 1.124 | 18.04 | 29.6 | 6 |
| 8 | 83/36 | 82.7 | 2.85 | 32.16 | 1.58 | 1.116 | 18.86 | 32.6 | 8 |
| 9 | 83/36 | 82.9 | 2.82 | 32.72 | 1.64 | 1.128 | 18.53 | 30.1 | 4 |

Example 3

This example provides a method for preparing a PET two-component elastic fiber and this method is basically the same as that of Example 2, except that: the intrinsic viscosity of the low-viscosity PET melt was controlled to be 0.50, and the intrinsic viscosity of the high-viscosity PET melt was controlled to be 0.75; after melt transfer, the online intrinsic viscosity of the low-viscosity PET melt was 0.487, the online intrinsic viscosity of the high-viscosity PET melt was 0.694, and the difference therebetween was 0.207. The fiber properties at different spinning positions on the same spinning producing line are shown in Table 3 below.

TABLE 3

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 83.2 | 2.92 | 29.76 | 1.602 | 1.078 | 17.82 | 32.4 | 4 |
| 2 | 83/36 | 82.5 | 2.90 | 30.17 | 1.63 | 1.084 | 18.08 | 31.6 | 4 |
| 3 | 83/36 | 83.0 | 2.93 | 28.58 | 1.58 | 1.064 | 18.25 | 33.1 | 6 |
| 4 | 83/36 | 82.6 | 2.89 | 30.10 | 1.60 | 1.088 | 18.17 | 32.0 | 4 |
| 5 | 83/36 | 82.9 | 2.97 | 30.69 | 1.59 | 1.090 | 17.94 | 31.8 | 4 |
| 6 | 83/36 | 82.7 | 2.94 | 29.98 | 1.63 | 1.125 | 18.30 | 30.7 | 6 |
| 7 | 83/36 | 82.3 | 2.90 | 31.30 | 1.51 | 1.124 | 18.24 | 29.6 | 6 |
| 8 | 83/36 | 82.7 | 2.93 | 30.16 | 1.66 | 1.116 | 18.36 | 32.3 | 8 |
| 9 | 83/36 | 82.4 | 2.92 | 29.72 | 1.54 | 1.128 | 18.13 | 31.9 | 4 |
| 10 | 83/36 | 82.7 | 2.91 | 28.57 | 1.67 | 1.124 | 18.31 | 32.8 | 4 |

Example 4

This example provides a method for preparing a PET two-component elastic fiber and this method is basically the same as that of Example 2, except that: the intrinsic viscosity of the low-viscosity PET melt was controlled to be 0.55, and the intrinsic viscosity of the high-viscosity PET melt was controlled to be 0.80 after melt transfer, the online intrinsic viscosity of the low-viscosity PET melt was 0.541, the online intrinsic viscosity of the high-viscosity PET melt was 0.744, and the difference therebetween was 0.203. The fiber properties at different spinning positions on the same spinning producing line are shown in Table 4 below.

TABLE 4

| No. | Specification | Denier count/ dtex | Strength/ cN/dtex | Elongation/ % | Oil content/% | Yarn Evenness CV/% | Boiling water shrinkage/ % rate water % | Crimp shrinkage rate/% | Interlacing point |
|---|---|---|---|---|---|---|---|---|---|
| 1 | 83/36 | 82.2 | 2.95 | 28.73 | 1.49 | 1.18 | 19.64 | 33.4 | 4 |
| 2 | 83/36 | 82.9 | 2.96 | 29.12 | 1.47 | 1.08 | 19.01 | 34.8 | 4 |
| 3 | 83/36 | 83.5 | 2.98 | 28.53 | 1.48 | 1.07 | 18.98 | 33.1 | 4 |
| 4 | 83/36 | 82.4 | 2.92 | 29.14 | 1.50 | 1.18 | 18.97 | 32.5 | 5 |
| 5 | 83/36 | 82.7 | 2.96 | 30.01 | 1.59 | 1.19 | 19.74 | 33.8 | 4 |
| 6 | 83/36 | 82.5 | 2.97 | 28.98 | 1.43 | 1.15 | 19.86 | 31.4 | 5 |
| 7 | 83/36 | 82.6 | 2.92 | 29.32 | 1.53 | 1.14 | 19.74 | 32.6 | 5 |
| 8 | 83/36 | 82.3 | 2.99 | 28.16 | 1.49 | 1.16 | 19.90 | 32.69 | 5 |
| 9 | 83/36 | 82.9 | 2.92 | 29.22 | 1.52 | 1.18 | 19.63 | 31.35 | 4 |
| 10 | 83/36 | 82.6 | 2.96 | 28.55 | 1.47 | 1.14 | 19.71 | 32.82 | 4 |

According to Examples 2 to 4, in the case where the heat stabilizer, the antioxidant and the colorant were added, the level of viscosity drop in the spinning process was greatly reduced, the degree of side reactions was effectively suppressed, the full roll rate of the fiber product was significantly increased; the fiber had the crimp significantly improved because of a larger viscosity difference between the two components, and the full roll rate of the fiber product was at the level of 91.5%-93.8%.

Example 5

This example provides a method for preparing a PET two-component elastic fiber and this method is basically the same as that of Example 2, except that: a viscosity reducer was also introduced by a pipe injector, the viscosity reducer was specifically amorphous polyester with an intrinsic viscosity of 0.64, tested using a mixed solvent of phenol and tetrachloroethane (v/v: 3:2), and the amount of the viscosity reducer was 0.5% relative to the total mass of the melt; the intrinsic viscosity of the low-viscosity melt was controlled to be 0.47, and the intrinsic viscosity of the high-viscosity melt was controlled to be 0.72; after melt transfer, the online intrinsic viscosity of the low-viscosity melt was 0.463, the online intrinsic viscosity of the high-viscosity melt was 0.670, and the difference therebetween was 0.207. The fiber properties at different spinning positions on the same spinning producing line are shown in Table 5 below.

TABLE 5

| No. | Specification | Denier count/ dtex | Strength/ cN/dtex | Elongation/ % | Oil content/% | Yarn Evenness CV/% | Boiling water shrinkage | Crimp shrinkage rate/% | Interlacing point |
|---|---|---|---|---|---|---|---|---|---|
| 1 | 83/36 | 82.8 | 2.92 | 32.72 | 1.65 | 1.088 | 18.76 | 28.7 | 4 |
| 2 | 83/36 | 82.6 | 2.86 | 32.19 | 1.63 | 1.080 | 19.01 | 29.2 | 4 |
| 3 | 83/36 | 83.1 | 2.90 | 32.58 | 1.59 | 1.074 | 19.41 | 28.1 | 5 |
| 4 | 83/36 | 82.8 | 2.94 | 32.13 | 1.50 | 1.081 | 18.95 | 29.0 | 4 |
| 5 | 83/36 | 82.3 | 2.87 | 31.64 | 1.59 | 1.070 | 18.74 | 28.5 | 5 |
| 6 | 83/36 | 82.7 | 2.85 | 33.00 | 1.53 | 1.055 | 19.35 | 28.4 | 4 |
| 7 | 83/36 | 82.6 | 2.87 | 31.81 | 1.62 | 1.094 | 19.04 | 29.1 | 4 |
| 8 | 83/36 | 82.3 | 2.86 | 33.16 | 1.58 | 1.106 | 18.89 | 27.9 | 6 |
| 9 | 83/36 | 82.4 | 2.82 | 32.76 | 1.54 | 1.080 | 18.83 | 29.3 | 4 |
| 10 | 83/36 | 82.9 | 2.89 | 32.52 | 1.57 | 1.094 | 18.76 | 28.7 | 5 |

Example 6

This example provides a method for preparing a PET two-component elastic fiber and this method is basically the same as that of Example 5, except that: the intrinsic viscosity of the low-viscosity melt was controlled to be 0.50, and the intrinsic viscosity of the high-viscosity melt was controlled to be 0.75; after melt transfer, the online intrinsic viscosity of the low-viscosity melt was 0.488, the online intrinsic viscosity of the high-viscosity melt was 0.690, and the difference therebetween was 0.202. The fiber properties at different spinning positions on the same spinning producing line are shown in Table 6 below.

TABLE 6

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 82.2 | 2.93 | 30.72 | 1.64 | 1.118 | 18.22 | 32.6 | 4 |
| 2 | 83/36 | 82.7 | 2.97 | 30.37 | 1.60 | 1.184 | 18.15 | 33.9 | 4 |
| 3 | 83/36 | 82.9 | 2.90 | 30.58 | 1.62 | 1.106 | 18.31 | 33.7 | 4 |
| 4 | 83/36 | 82.6 | 2.86 | 31.10 | 1.60 | 1.180 | 18.19 | 32.2 | 4 |
| 5 | 83/36 | 82.9 | 2.94 | 30.66 | 1.59 | 1.192 | 18.74 | 33.5 | 4 |
| 6 | 83/36 | 82.3 | 2.97 | 30.92 | 1.63 | 1.125 | 18.37 | 32.8 | 5 |
| 7 | 83/36 | 82.8 | 2.89 | 31.01 | 1.58 | 1.134 | 18.24 | 33.0 | 4 |
| 8 | 83/36 | 83.7 | 2.98 | 31.16 | 1.62 | 1.126 | 18.53 | 32.8 | 6 |
| 9 | 83/36 | 82.5 | 2.93 | 30.70 | 1.54 | 1.121 | 18.49 | 32.4 | 4 |
| 10 | 83/36 | 82.1 | 2.96 | 31.03 | 1.57 | 1.112 | 18.72 | 32.9 | 5 |

Example 7

This example provides a method for preparing a PET two-component elastic fiber and this method is basically the same as that of Example 5, except that: the amount of the viscosity reducer was adjusted to 0.8%; the intrinsic viscosity of the low-viscosity melt was controlled to be 0.55, and the intrinsic viscosity of the high-viscosity melt was controlled to be 0.80; after melt transfer, the online intrinsic viscosity of the low-viscosity melt was 0.540, the online intrinsic viscosity of the high-viscosity melt was 0.748, and the difference therebetween was 0.208. The fiber properties at different spinning positions on the same spinning producing line are shown in Table 7 below.

TABLE 7

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 82.7 | 3.11 | 30.06 | 1.45 | 1.28 | 17.79 | 35.2 | 4 |
| 2 | 83/36 | 82.9 | 3.06 | 30.17 | 1.47 | 1.24 | 17.82 | 35.8 | 4 |
| 3 | 83/36 | 83.0 | 3.12 | 30.53 | 1.52 | 1.30 | 18.01 | 36.1 | 6 |
| 4 | 83/36 | 82.8 | 3.08 | 29.90 | 1.40 | 1.18 | 18.12 | 35.4 | 5 |
| 5 | 83/36 | 82.9 | 3.17 | 30.22 | 1.49 | 1.29 | 17.78 | 36.2 | 4 |
| 6 | 83/36 | 82.8 | 3.06 | 29.98 | 1.53 | 1.25 | 17.93 | 35.4 | 5 |
| 7 | 83/36 | 82.6 | 3.15 | 30.62 | 1.41 | 1.24 | 18.00 | 35.6 | 4 |
| 8 | 83/36 | 82.7 | 3.18 | 29.86 | 1.52 | 1.16 | 17.86 | 35.9 | 5 |
| 9 | 83/36 | 82.9 | 3.09 | 29.72 | 1.44 | 1.28 | 17.53 | 36.1 | 4 |
| 10 | 83/36 | 82.8 | 3.14 | 30.33 | 1.47 | 1.24 | 17.78 | 35.6 | 4 |

According to Examples 5-7, after addition of the viscosity reducer, the basic physical and chemical indicators of the finished fiber yarn did not change significantly, but the spinning conditions were significantly improved, and the full roll rate increased to 94.2% to 95.7%. All these indicate that the addition of the viscosity reducer increased the full roll rate of the product and also significantly reduced irregular breakage during the spinning process.

Example 8

This example provides a method for preparing a PET two-component elastic fiber and this method is basically the same as that of Example 2, except that: a solid-phase smoothing agent was also introduced from a solid-phase smoothing agent injection system, the solid-phase smoothing agent was specifically polyester masterbatch of barium sulfate powder with a particle size of 20 to 100 nm, and the amount of the solid-phase smoothing agent was 0.2% relative to the total mass of the melt; the intrinsic viscosity of the low-viscosity melt was controlled to be 0.47, and the intrinsic viscosity of the high-viscosity melt was controlled to be 0.72; after melt transfer, the online intrinsic viscosity of the low-viscosity melt was 0.460, the online intrinsic viscosity of the high-viscosity melt was 0.665, and the difference therebetween was 0.205. The fiber properties at different spinning positions on the same spinning producing line are shown in Table 8 below.

TABLE 8

| No. | Specification | Denier count/ dtex | Strength/ cN/dtex | Elongation/ % | Oil content/% | Yarn Evenness CV/% | Boiling water shrinkage/ % rate | Crimp shrinkage rate/% | Interlacing point |
|---|---|---|---|---|---|---|---|---|---|
| 1 | 83/36 | 82.4 | 2.81 | 32.25 | 1.19 | 1.23 | 19.22 | 30.4 | 4 |
| 2 | 83/36 | 83.5 | 2.79 | 32.33 | 1.17 | 1.25 | 18.76 | 29.7 | 4 |
| 3 | 83/36 | 83.3 | 2.83 | 32.59 | 1.18 | 1.21 | 18.49 | 30.4 | 4 |
| 4 | 83/36 | 82.8 | 2.84 | 32.52 | 1.22 | 1.18 | 18.71 | 30.8 | 4 |
| 5 | 83/36 | 82.7 | 2.76 | 33.31 | 1.19 | 1.23 | 18.74 | 30.1 | 4 |
| 6 | 83/36 | 82.9 | 2.83 | 33.50 | 1.15 | 1.25 | 18.65 | 30.9 | 4 |
| 7 | 83/36 | 82.7 | 2.78 | 32.82 | 1.22 | 1.12 | 18.94 | 29.7 | 5 |
| 8 | 83/36 | 83.4 | 2.80 | 33.06 | 1.17 | 1.16 | 18.83 | 30.6 | 4 |
| 9 | 83/36 | 82.9 | 2.82 | 32.77 | 1.24 | 1.28 | 18.57 | 30.8 | 4 |
| 10 | 83/36 | 83.6 | 2.79 | 32.59 | 1.18 | 1.26 | 18.82 | 30.0 | 4 |

Example 9

This example provides a method for preparing a PET two-component elastic fiber and this method is basically the same as that of Example 8, except that: the amount of the solid-phase smoothing agent was adjusted to 0.3%; the intrinsic viscosity of the low-viscosity melt was controlled to be 0.50, and the intrinsic viscosity of the high-viscosity melt was controlled to be 0.75; after melt transfer, the online intrinsic viscosity of the low-viscosity melt was 0.482, the online intrinsic viscosity of the high-viscosity melt was 0.684, and the difference therebetween was 0.202. The fiber properties at different spinning positions on the same spinning producing line are shown in Table 9 below.

TABLE 9

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 83.7 | 2.94 | 30.74 | 1.45 | 1.35 | 18.02 | 31.4 | 4 |
| 2 | 83/36 | 82.6 | 2.97 | 31.10 | 1.47 | 1.34 | 18.07 | 31.6 | 4 |

TABLE 9-continued

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 3 | 83/36 | 83.5 | 2.90 | 31.51 | 1.51 | 1.39 | 18.21 | 32.1 | 4 |
| 4 | 83/36 | 82.5 | 3.05 | 30.18 | 1.44 | 1.28 | 18.00 | 32.0 | 4 |
| 5 | 83/36 | 82.2 | 3.11 | 30.63 | 1.49 | 1.33 | 17.84 | 32.8 | 4 |
| 6 | 83/36 | 82.6 | 2.89 | 31.90 | 1.43 | 1.25 | 18.01 | 31.4 | 4 |
| 7 | 83/36 | 83.6 | 3.06 | 31.32 | 1.48 | 1.34 | 18.24 | 30.6 | 4 |
| 8 | 83/36 | 82.9 | 2.95 | 30.16 | 1.53 | 1.36 | 18.15 | 32.3 | 4 |
| 9 | 83/36 | 83.0 | 3.08 | 30.77 | 1.44 | 1.28 | 18.03 | 32.1 | 4 |
| 10 | 83/36 | 83.3 | 2.97 | 30.55 | 1.46 | 1.31 | 17.96 | 31.8 | 5 |

Example 10

This example provides a method for preparing a PET two-component elastic fiber and this method is basically the same as that of Example 8, except that: the amount of the solid-phase smoothing agent was adjusted to 0.4%; the intrinsic viscosity of the low-viscosity melt was controlled to be 0.55, and the intrinsic viscosity of the high-viscosity melt was controlled to be 0.80; after melt transfer, the online intrinsic viscosity of the low-viscosity melt was 0.535, the online intrinsic viscosity of the high-viscosity melt was 0.736, and the difference therebetween was 0.201. The fiber properties at different spinning positions on the same spinning producing line are shown in Table 10 below.

TABLE 10

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 83.7 | 3.03 | 28.70 | 1.55 | 1.31 | 17.73 | 34.4 | 4 |
| 2 | 83/36 | 83.4 | 3.10 | 28.19 | 1.57 | 1.24 | 17.01 | 34.8 | 4 |
| 3 | 83/36 | 83.1 | 2.99 | 28.58 | 1.61 | 1.33 | 17.43 | 34.1 | 4 |
| 4 | 83/36 | 82.8 | 3.08 | 28.19 | 1.59 | 1.28 | 17.54 | 34.5 | 4 |
| 5 | 83/36 | 83.5 | 3.05 | 28.64 | 1.62 | 1.29 | 17.74 | 33.8 | 4 |
| 6 | 83/36 | 83.8 | 3.12 | 27.97 | 1.54 | 1.25 | 17.33 | 34.2 | 4 |
| 7 | 83/36 | 82.9 | 3.07 | 29.02 | 1.52 | 1.28 | 17.49 | 33.8 | 4 |
| 8 | 83/36 | 83.8 | 3.11 | 28.57 | 1.63 | 1.19 | 17.86 | 34.6 | 4 |
| 9 | 83/36 | 82.9 | 3.04 | 28.72 | 1.54 | 1.286 | 17.76 | 33.4 | 5 |
| 10 | 83/36 | 83.3 | 3.08 | 28.78 | 1.57 | 1.24 | 17.92 | 33.8 | 4 |

According to Examples 8-10, after addition of the solid-phase smoothing agent, the basic physical and chemical indicators of the finished fiber yarn did not change significantly, but the spinning conditions were significantly improved, and the full roll rate increased to 93.5% to 94.9%. All these indicate that the addition of the solid-phase smoothing agent increased the full roll rate of the product and also significantly reduced irregular breakage during the spinning process.

Example 11

This example provides a method for preparing a PET two-component elastic fiber and this method is basically the same as that of Example 2, except that: a liquid-phase lubricant was also introduced from a liquid-phase lubricant injection system, the liquid-phase lubricant was specifically poly(ethylene glycol)adipate with a molecular weight of 8000, and the amount of the liquid-phase lubricant was 0.2% relative to the total mass of the melt; the intrinsic viscosity of the low-viscosity melt was controlled to be 0.47, and the intrinsic viscosity of the high-viscosity melt was controlled to be 0.72; after melt transfer, the online intrinsic viscosity of the low-viscosity melt was 0.463, the online intrinsic viscosity of the high-viscosity melt was 0.668, and the difference therebetween was 0.205. The fiber properties at different spinning positions on the same spinning producing line are shown in Table 11 below.

TABLE 11

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 82.7 | 2.87 | 32.27 | 1.48 | 1.58 | 18.31 | 31.7 | 5 |
| 2 | 83/36 | 82.9 | 2.90 | 32.35 | 1.57 | 1.54 | 18.09 | 31.2 | 4 |
| 3 | 83/36 | 83.0 | 2.82 | 32.58 | 1.51 | 1.49 | 18.22 | 30.6 | 4 |
| 4 | 83/36 | 82.8 | 2.86 | 32.65 | 1.44 | 1.58 | 18.17 | 31.8 | 4 |
| 5 | 83/36 | 82.9 | 2.79 | 32.62 | 1.48 | 1.47 | 17.89 | 32.1 | 5 |
| 6 | 83/36 | 82.8 | 2.87 | 31.98 | 1.43 | 1.55 | 18.13 | 31.4 | 4 |
| 7 | 83/36 | 82.6 | 2.81 | 32.81 | 1.52 | 1.43 | 18.06 | 32.6 | 4 |
| 8 | 83/36 | 82.7 | 2.92 | 32.18 | 1.49 | 1.46 | 18.35 | 31.3 | 4 |
| 9 | 83/36 | 82.9 | 2.88 | 31.75 | 1.53 | 1.58 | 18.42 | 32.1 | 5 |
| 10 | 83/36 | 82.8 | 2.89 | 32.57 | 1.47 | 1.54 | 18.29 | 31.7 | 4 |

Example 12

This example provides a method for preparing a PET two-component elastic fiber and this method is basically the same as that of Example 11, except that: the amount of the liquid-phase lubricant was adjusted to 0.3%; the intrinsic viscosity of the low-viscosity melt was controlled to be 0.50, and the intrinsic viscosity of the high-viscosity melt was controlled to be 0.75; after melt transfer, the online intrinsic viscosity of the low-viscosity melt was 0.489, the online intrinsic viscosity of the high-viscosity melt was 0.687, and the difference therebetween was 0.198. The fiber properties at different spinning positions on the same spinning producing line are shown in Table 12 below.

TABLE 12

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 82.7 | 3.11 | 29.25 | 1.49 | 1.19 | 18.05 | 33.4 | 4 |
| 2 | 83/36 | 82.9 | 3.07 | 30.12 | 1.47 | 1.14 | 18.03 | 33.3 | 4 |
| 3 | 83/36 | 83.0 | 3.15 | 29.58 | 1.50 | 1.16 | 18.11 | 33.6 | 4 |
| 4 | 83/36 | 82.8 | 3.06 | 29.54 | 1.44 | 1.18 | 18.00 | 32.7 | 4 |
| 5 | 83/36 | 82.9 | 2.99 | 30.22 | 1.49 | 1.19 | 17.97 | 32.8 | 4 |
| 6 | 83/36 | 82.8 | 3.13 | 29.96 | 1.52 | 1.12 | 18.06 | 33.8 | 5 |
| 7 | 83/36 | 82.6 | 3.09 | 29.81 | 1.48 | 1.24 | 18.14 | 32.6 | 4 |
| 8 | 83/36 | 82.7 | 3.14 | 29.77 | 1.50 | 1.16 | 18.06 | 32.3 | 4 |
| 9 | 83/36 | 82.9 | 3.16 | 30.25 | 1.44 | 1.18 | 17.93 | 33.4 | 4 |
| 10 | 83/36 | 82.7 | 3.12 | 29.58 | 1.47 | 1.20 | 18.15 | 32.8 | 4 |

This example provides a method for preparing a PET two-component elastic fiber and this method is basically the same as that of Example 11, except that: the amount of the liquid-phase lubricant was adjusted to 0.4%; the intrinsic viscosity of the low-viscosity melt was controlled to be 0.55, and the intrinsic viscosity of the high-viscosity melt was controlled to be 0.80; after melt transfer, the online intrinsic viscosity of the low-viscosity melt was 0.539, the online intrinsic viscosity of the high-viscosity melt was 0.738, and the difference therebetween was 0.199. The fiber properties at different spinning positions on the same spinning producing line are shown in Table 13 below.

TABLE 13

| No. | Specification | Denier count/ dtex | Strength/ cN/dtex | Elongation/ % | Oil content/% | Yarn Evenness CV/% | Boiling water shrinkage/ % | Crimp shrinkage rate/% | Interlacing point |
|---|---|---|---|---|---|---|---|---|---|
| 1 | 83/36 | 83.2 | 3.21 | 28.55 | 1.62 | 1.24 | 17.75 | 35.4 | 4 |
| 2 | 83/36 | 82.7 | 3.18 | 28.76 | 1.61 | 1.28 | 17.64 | 34.8 | 4 |
| 3 | 83/36 | 83.5 | 3.20 | 28.79 | 1.58 | 1.19 | 17.58 | 35.2 | 5 |
| 4 | 83/36 | 82.9 | 3.17 | 28.52 | 1.66 | 1.17 | 17.69 | 34.3 | 4 |
| 5 | 83/36 | 83.6 | 3.21 | 29.01 | 1.57 | 1.25 | 17.74 | 34.8 | 4 |
| 6 | 83/36 | 82.4 | 3.15 | 28.68 | 1.62 | 1.22 | 17.77 | 35.4 | 4 |
| 7 | 83/36 | 83.3 | 3.22 | 29.06 | 1.67 | 1.27 | 17.59 | 35.6 | 4 |
| 8 | 83/36 | 82.8 | 3.27 | 28.71 | 1.58 | 1.18 | 17.86 | 35.2 | 4 |
| 9 | 83/36 | 82.6 | 3.24 | 28.89 | 1.60 | 1.22 | 17.82 | 35.2 | 4 |
| 10 | 83/36 | 83.5 | 3.18 | 29.06 | 1.56 | 1.27 | 17.66 | 34.8 | 5 |

According to Examples 10-13, after addition of the solid-phase smoothing agent, the basic physical and chemical indicators of the finished fiber yarn did not change significantly, but the spinning conditions were significantly improved, and the full roll rate increased to 94.3% to 96.6%. All these indicate that the addition of the solid-phase smoothing agent increased the full roll rate of the product and also significantly reduced irregular breakage during the spinning process.

Comparative Example 1

This example provides a method for preparing a PET two-component elastic fiber and this method is basically the same as that of Example 2, except that: no heat stabilizer or antioxidant was introduced into the second esterification reactor; the intrinsic viscosity of the low-viscosity melt was controlled to be 0.47, and the intrinsic viscosity of the high-viscosity melt was controlled to be 0.75; after melt transfer, the online intrinsic viscosity of the low-viscosity melt was 0.451, the online intrinsic viscosity of the high-viscosity melt was 0.653, and the difference therebetween was 0.202. The fiber properties at different spinning positions on the same spinning line are shown in Table 14 below.

TABLE 14

| No. | Specification | Denier count/ dtex | Strength/ cN/dtex | Elongation/ % | Oil content/% | Yarn Evenness CV/% | Boiling water shrinkage/ % rate | Crimp shrinkage rate/% | Interlacing point |
|---|---|---|---|---|---|---|---|---|---|
| 1 | FDY | 83/36 | 83.1 | 2.86 | 34.65 | 1.11 | 0.74 | 21.7 | 18.13 |
| 2 | FDY | 83/36 | 83.4 | 2.79 | 34.28 | 1.12 | 0.54 | 21.4 | 18.92 |
| 3 | FDY | 83/36 | 83.2 | 2.84 | 32.95 | 1.12 | 0.83 | 21.8 | 17.85 |
| 4 | FDY | 83/36 | 83.2 | 2.85 | 34.48 | 1.10 | 0.90 | 21.8 | 18.90 |
| 5 | FDY | 83/36 | 83.6 | 2.83 | 30.78 | 1.09 | 0.78 | 21.7 | 19.10 |
| 6 | FDY | 83/36 | 82.4 | 2.83 | 30.95 | 1.11 | 0.74 | 22.1 | 19.78 |

TABLE 14-continued

| No. | Specification | Denier count/ dtex | Strength/ cN/dtex | Elongation/ % | Oil content/% | Yarn Evenness CV/% | Boiling water shrinkage/ % rate | Crimp shrinkage rate/% | Interlacing point |
|---|---|---|---|---|---|---|---|---|---|
| 7 | FDY | 83/36 | 83.0 | 2.88 | 32.60 | 1.11 | 0.81 | 21.7 | 18.34 |
| 8 | FDY | 83/36 | 83.5 | 2.81 | 31.92 | 1.11 | 0.80 | 22.1 | 18.22 |
| 9 | FDY | 83/36 | 83.4 | 2.82 | 33.78 | 1.14 | 0.85 | 22.0 | 17.26 |

Comparative Example 2

This example provides a method for preparing a PET two-component elastic fiber and this method is basically the same as that of Example 2, except that: no heat stabilizer or antioxidant was introduced into the second esterification reactor; the intrinsic viscosity of the low-viscosity melt was controlled to be 0.50, and the intrinsic viscosity of the high-viscosity melt was controlled to be 0.78; after melt transfer, the online viscosity of the low-viscosity melt was 0.467, the online viscosity of the high-viscosity melt was 0.661, and the difference therebetween was 0.143 (which was reduced significantly). The fiber properties at different spinning positions on the same spinning line are shown in Table 15 below.

TABLE 15

| No. | Specification | Denier count/ dtex | Strength/ cN/dtex | Elongation/ % | Oil content/% | Yarn Evenness CV/% | Boiling water shrinkage/ % rate | Crimp shrinkage rate/% | Interlacing point |
|---|---|---|---|---|---|---|---|---|---|
| 1 | 83/36 | 83.7 | 2.91 | 29.76 | 1.60 | 1.17 | 17.99 | 16.4 | 4 |
| 2 | 83/36 | 83.9 | 2.96 | 29.17 | 1.67 | 1.18 | 18.12 | 16.5 | 4 |
| 3 | 83/36 | 84.0 | 2.96 | 28.58 | 1.58 | 1.16 | 18.32 | 17.2 | 4 |
| 4 | 83/36 | 83.8 | 2.96 | 30.10 | 1.20 | 1.18 | 18.18 | 17.0 | 4 |
| 5 | 83/36 | 83.9 | 2.96 | 29.64 | 1.09 | 1.19 | 17.94 | 17.3 | 4 |
| 6 | 83/36 | 82.8 | 2.95 | 28.98 | 1.13 | 1.15 | 18.36 | 17.4 | 4 |
| 7 | 83/36 | 83.6 | 2.97 | 29.81 | 1.31 | 1.14 | 18.24 | 16.9 | 4 |
| 8 | 83/36 | 82.7 | 2.95 | 28.16 | 0.98 | 1.16 | 18.83 | 18.2 | 4 |
| 9 | 83/36 | 82.9 | 2.92 | 28.72 | 1.94 | 1.18 | 18.59 | 17.1 | 4 |
| 10 | 83/36 | 83.8 | 2.99 | 30.53 | 1.17 | 1.14 | 18.75 | 18.1 | 4 |

Comparative Example 3

This example provides a method for preparing a PET two-component elastic fiber and this method is basically the same as that of Example 2, except that: no heat stabilizer or antioxidant was introduced into the second esterification reactor; the intrinsic viscosity of the low-viscosity melt was controlled to be 0.55, and the intrinsic viscosity of the high-viscosity melt was controlled to be 0.85; after melt transfer, the online viscosity of the low-viscosity melt was 0.519, the online viscosity of the high-viscosity melt was 0.667, and the difference therebetween was 0.148 (which was reduced significantly). The fiber properties at different spinning positions on the same spinning line are shown in Table 16 below.

TABLE 16

| No. | Specification | Denier count/ dtex | Strength/ cN/dtex | Elongation/ % | Oil content/% | Yarn Evenness CV/% | Boiling water shrinkage | Crimp shrinkage rate/% | Interlacing point |
|---|---|---|---|---|---|---|---|---|---|
| 1 | 83/36 | 83.7 | 2.95 | 28.70 | 1.50 | 1.33 | 18.62 | 19.2 | 4 |
| 2 | 83/36 | 82.8 | 3.00 | 27.17 | 1.57 | 1.34 | 18.19 | 19.6 | 4 |
| 3 | 83/36 | 83.1 | 2.99 | 28.52 | 1.58 | 1.42 | 18.47 | 20.1 | 4 |
| 4 | 83/36 | 82.5 | 3.01 | 27.19 | 1.60 | 1.38 | 18.22 | 20.2 | 4 |

TABLE 16-continued

| No. | Specification | Denier count/ dtex | Strength/ cN/dtex | Elongation/ % | Oil content/% | Yarn Evenness CV/% | Boiling water shrinkage | Crimp shrinkage rate/% | Interlacing point |
|---|---|---|---|---|---|---|---|---|---|
| 5 | 83/36 | 82.9 | 3.05 | 28.60 | 1.59 | 1.39 | 18.74 | 20.8 | 4 |
| 6 | 83/36 | 82.5 | 2.98 | 27.98 | 1.63 | 1.45 | 18.56 | 20.0 | 4 |
| 7 | 83/36 | 82.8 | 3.00 | 27.87 | 1.51 | 1.34 | 18.34 | 19.8 | 4 |
| 8 | 83/36 | 82.7 | 3.03 | 28.16 | 1.68 | 1.36 | 18.45 | 21.6 | 4 |
| 9 | 83/36 | 82.4 | 2.98 | 27.79 | 1.64 | 1.38 | 18.65 | 20.1 | 4 |
| 10 | 83/36 | 82.6 | 3.05 | 28.51 | 1.57 | 1.34 | 18.70 | 20.7 | 4 |

According to Comparative Examples 1 to 3, in the case where no heat stabilizer or antioxidant was added, the level of viscosity drop in the spinning process was high, the degree of side reactions was high, the product had a yellowish hue and a low fiber full roll rate; because of a small viscosity difference between the two components of the fiber, the crimp shrinkage rate and the actual width of the fabric were both low.

The specific values of the full roll rate of the fibers prepared in Examples 2 to 13 and Comparative Examples 1 to 3 are shown in Table 17 below, where the full roll rate was tested in accordance with the GBT8960-2015 standard.

TABLE 17

| Example No. | Full roll rate |
|---|---|
| Example 1 | 91.5% |
| Example 2 | 93.8% |
| Example 3 | 92.4% |
| Example 4 | 95.7% |
| Example 5 | 94.9% |
| Example 6 | 94.2% |
| Example 7 | 93.5% |
| Example 8 | 94.2% |
| Example 9 | 94.9% |
| Example 10 | 94.3% |
| Example 11 | 96.6% |
| Example 12 | 95.2% |
| Example 13 | 94.8% |
| Comparative | 88.7% |
| Comparative | 91.9% |
| Comparative | 90.5% |

The above embodiments are only for illustrating the technical concept and features of the disclosure, and their purpose is to enable people familiar with this technology to understand the content of the disclosure and implement it accordingly, but not to limit the scope of the disclosure. Any equivalent changes or modifications made according to the spirit of the disclosure should fall within the scope of the disclosure.

What is claimed is:

1. A method for preparing a melt-spun polyethylene terephthalate (PET) two-component elastic fiber, the preparation method comprising steps of sequentially passing terephthalic acid, ethylene glycol and a catalyst through a first esterification reactor and a second esterification reactor f or esterification reaction, a first prepolymerization reactor and a second prepolymerization reactor for prepolymerization reaction to obtain an ethylene terephthalate prepolymer, wherein, the preparation method further comprises a step of introducing the ethylene terephthalate prepolymer into a final polymerization reactor for polymerization, wherein the final polymerization reactor has a low-viscosity melt outlet f rom which a low-viscosity PET melt is discharged and a high-viscosity melt outlet from which a high-viscosity PET melt is discharged, the low-viscosity PET melt has an intrinsic viscosity of 0.45-0.60 dL/g, and a dynamic viscosity of 90-300 Pa·s at 280° C., and the high-viscosity PET melt has an intrinsic viscosity of 0.68-0.80 dL/g, and a dynamic viscosity of 450-810 Pa·s at 284° C.; and a step of spinning the low-viscosity PET melt and the high-viscosity PET melt through a same parallel composite spinning assembly to obtain the melt-spun PET two-component elastic fiber; the final polymerization reactor is a horizontal polymerization reactor and comprises a main body containing a chamber internally, the main body comprises a low-viscosity zone, a medium-high-viscosity zone, and a high-viscosity zone which are arranged in sequence along an axial direction of the final polymerization reactor, and the viscosity of the polyethylene terephthalate melt in the low-viscosity zone, the medium-high-viscosity zone, and the high-viscosity zone increases in sequence, the low-viscosity melt outlet is arranged at a rear end of the low-viscosity zone, and the high-viscosity melt outlet is arranged at a rear end of the high-viscosity zone; the final polymerization reactor further comprises a prepolymer inlet arranged at a front end of the final polymerization reactor, and two agitating shafts, one of which is arranged in the low-viscosity zone and the other is arranged in the medium-high-viscosity zone and the high-viscosity zone, as well as a weir plate arranged at a rear end of the low-viscosity melt outlet and configured to prevent the melt in the medium-high-viscosity zone from flowing into the low-viscosity zone.

2. The preparation method according to claim 1, wherein, the central axes of the two agitating shafts are located on a same straight line, and the final polymerization reactor further comprises a support column arranged on an inner wall of the main body, and the support column is configured to support the two agitating shafts and is located at the rear end of the low-viscosity zone.

3. The preparation method according to claim 1, wherein, the length of the agitating shaft arranged in the low-viscosity zone is two-thirds of the length of the final polymerization reactor, the length of the agitating shaft arranged in the medium-high-viscosity zone and the high-viscosity zone is one-third of the length of the final polymerization reactor, the length of the low-viscosity zone is two-thirds of the length of the final polymerization reactor, and the length of the medium-high-viscosity zone and the high-viscosity zone is one-third of the length of the final polymerization reactor.

4. The preparation method according to claim 3, wherein, each of the two agitating shafts is provided with a plurality of disc reactors, the disc reactors in the low-viscosity zone are multi-disc combinations, and 6 to 8 multi-disc combinations are arranged in the low-viscosity zone, and the number of the disc reactors in the low-viscosity zone is 35 to 50; the disc reactors in the medium-high-viscosity zone are four-disc combinations, three-disc combinations or two-disc combinations, and the number of the disc reactors in the medium-high-viscosity zone is 15 to 25; the disc reactors in the high-viscosity zone are in a single-disc design, and the number of the disc reactors in the high-viscosity zone is 6 to 15.

5. The preparation method according to claim 3, wherein, the final polymerization reactor further comprises a wall scraper arranged in the medium-high-viscosity zone to remove the melt from the inner wall of the final polymerization reactor, a disc scraper arranged in the high-viscosity zone to remove the melt from the disc reactors, a wall scraper arranged in the high-viscosity zone to remove the melt from the inner wall of the final polymerization reactor, and an axial scraper arranged in the high-viscosity zone to remove the melt from the agitating shaft.

6. The preparation method according to claim 1, wherein, the weir plate is welded to the inner wall at the bottom of the main body, and in a cross section of the final polymerization reactor passing through the weir plate, the curvature of a contact line between the weir plate and the inner wall at the bottom of the main body is greater than or equal to $\pi/6$, and a lowest point of an upper edge of the weir plate is not lower than a secant line of the cross section passing through two end points of the contact line.

7. The preparation method according to claim 6, wherein the cross section of the weir plate is in an inverted trumpet shape, and in the front-rear direction of the final polymerization reactor, the weir plate is adjacent to the low-viscosity melt outlet.

8. The preparation method according to claim 4, wherein, the spacing between the multi-disc combinations and between each disc in one multi-disc combination in the low-viscosity zone, the spacing between the two-disc combinations and between each disc in one two-disc combinations in the medium-high-viscosity zone, the spacing between the discs of the single discs in the high-viscosity zone increase in sequence; the diameters of the multiple disc reactors in the high-viscosity zone decrease in sequence from front to rear, and the diameter of the disc reactor at a most rear end of the high-viscosity zone is 85%-90% of the diameter of the disc reactor at a most front end of the high-viscosity zone.

9. The preparation method according to claim 4, wherein, the disc reactors in the high-viscosity zone are at an angle of 1.0-3.0° with the vertical direction of the agitating shaft, and the upper ends of the disc reactors face the rear end of the high-viscosity zone.

10. The preparation method according to claim 1, wherein, the final polymerization reactor further comprises steam feed ports for introducing superheated ethylene glycol steam arranged at the top of the main body corresponding to the rear end of the low-viscosity zone, the rear end of the medium-high-viscosity zone, and the rear end of the high-viscosity zone; the preparation method further comprises steps of metering the superheated ethylene glycol steam with a metering system and introducing the steam into the final polymerization reactor.

11. The preparation method according to claim 1, wherein, the final polymerization reactor is connected to a vacuum pump, the vacuum pump is a liquid ring pump and a chilled water device for cooling gas is arranged at an inlet of the liquid ring pump; in the preparation method, the vacuum pump is controlled to have a sucking rate of 200-350 kg/h, the vacuum pump has an ultimate vacuum of 50-65 Pa, and in a production state, the vacuum degree in the final polymerization reactor is controlled to be 100-180 Pa.

12. The preparation method according to claim 1, wherein, melt pumps are used to transfer the high-viscosity PET melt and the low-viscosity PET melt, a melt cooler is arranged at an outlet of each melt pump, and in the preparation method, the temperature of the high-viscosity PET melt cooled by the melt cooler is controlled to be 284-286° C.; a filter and a booster pump are arranged between each melt pump and the parallel composite spinning assembly; in the preparation method, the transfer time of the high-viscosity PET melt is controlled to be 25-35 min; and a plurality of static slow-flow mixers are arranged at a front end of a melt pipeline.

13. The preparation method according to claim 1, wherein, the preparation method further comprising a step of introducing a heat stabilizer, an antioxidant or a colorant into the second esterification reactor before the esterification reaction in the second esterification reactor, wherein the heat stabilizer is selected from the group consisting of trimethyl phosphate, triethyl phosphate, triphenyl phosphate, triphenyl phosphite, triglycerol phosphate, and combinations thereof; the antioxidant is selected from the group consisting of Antioxidant 168, Antioxidant 1076, Antioxidant 1010, Antioxidant 1222, benzothiazole antioxidants, and combinations thereof.

14. The preparation method according to claim 1, wherein, a filter is arranged between the low-viscosity melt outlet of the final polymerization reactor and the parallel composite spinning assembly and between the high-viscosity melt outlet of the final polymerization reactor and the parallel composite spinning assembly, respectively; the preparation method further comprises a step of introducing a viscosity reducer into the high-viscosity PET melt by a pipe injector before the high-viscosity PET melt passes through the filter; the viscosity reducer is selected from the group consisting of poly(ethylene terephthalateco-1,4-cyclohexanedimethylene terephthalate) PETG, cationic dyeable polyester CDP, easy cationic dyeable polyester ECDP, atmospheric pressure boiling dyeing polyester EDDP, polybutylene terephthalate PBT, poly(trimethylene terephthalate) PTT, amorphous polyester and combinations thereof; the amount of the viscosity reducer is 0.2% to 3.0% of the total mass of the melt; or the preparation method further comprises a step of introducing a solid-phase smoothing agent into the ethylene terephthalate prepolymer before introducing the ethylene terephthalate prepolymer into the final polymerization reactor, and a step of passing a mixture of the solid-phase smoothing agent and the ethylene terephthalate prepolymer through a filter, wherein the solid-phase smoothing agent is in the form of a masterbatch and comprises a polyester matrix and an inorganic powder, the inorganic powder is selected from the group consisting of talc powder, montmorillonite, barium sulfate, hydrotalcite, nano silica, and combinations thereof, and the amount of the solid-phase smoothing agent is 0.05%-1.0% of the total mass of the melt.

15. The preparation method according to claim 1, wherein, a filter is arranged between the low-viscosity melt outlet of the final polymerization reactor and the parallel composite spinning assembly and between the high-viscosity melt outlet of the final polymerization reactor and the parallel composite spinning assembly, respectively; the preparation method further comprises a step of introducing a liquid-phase lubricant into the high-viscosity PET melt before the high-viscosity PET melt passes through the filter; the liquid-phase lubricant is one or more of polyethylene glycol with a molecular weight of 8000-20000, polyetheramine with a molecular weight of 10000-20000, poly(butylene glycol)adipate with a molecular weight of 5000-20000, poly(ethylene glycol)adipate with a molecular weight of 5000-20000, and polyacrylate, and the amount of the liquid-phase lubricant is 0.1%-2.0% of the total mass of the melt.

16. The preparation method according to claim 1, wherein, in percent by weight, the PET two-component elastic fiber comprises 30%-70% of a high-viscosity PET component and 70%-30% of a low-viscosity PET component, and the viscosity of the high-viscosity PET component is different from the viscosity of the low-viscosity PET component.

17. The preparation method according to claim 1, wherein, a difference between the intrinsic viscosity of the high-viscosity PET melt and the intrinsic viscosity of the low-viscosity PET melt is 0.18-0.35 dL/g, and a difference between the dynamic viscosity of the high-viscosity PET melt and the dynamic viscosity of the low-viscosity PET melt is 250-700 Pa·s.

* * * * *